United States Patent [19]

Cotton

[11] 4,114,664

[45] Sep. 19, 1978

[54] APPARATUS FOR ROUTING DESIGNS IN PANELS

[75] Inventor: Lawrence M. Cotton, New Bern, N.C.

[73] Assignee: The Stanley Works, New Britain, Conn.

[21] Appl. No.: 744,528

[22] Filed: Nov. 24, 1976

[51] Int. Cl.[2] ..... B27C 5/10; B27C 5/00

[52] U.S. Cl. ..... 144/134 D; 33/189; 51/34 A; 90/12 D; 125/8; 144/144 R

[58] Field of Search ..... 90/12 D, DIG. 3; 33/189, 23 B, 23 K, 23 H; 125/8; 51/34 A, 35; 144/134 D, 136 C, 144 R, 145 R

[56] References Cited

U.S. PATENT DOCUMENTS

| | | | |
|---|---|---|---|
| 1,895,054 | 1/1933 | Steinmeyer | 144/136 R |
| 3,541,922 | 11/1970 | Dunlap | 144/144 R X |
| 3,543,636 | 12/1970 | Tracy | 144/144 R X |
| 3,770,031 | 11/1973 | Olson | 144/136 R |

*Primary Examiner*—Gil Weidenfeld
*Assistant Examiner*—W. D. Bray
*Attorney, Agent, or Firm*—Prutzman, Hayes, Kalb & Chilton

[57] ABSTRACT

Apparatus is provided for supporting and guiding a router for the purpose of routing an ornamental design in panels such as cabinet doors and drawer fronts. The router is attached to the end of a bar extending over the workpiece, the bar being slidable longitudinally in a carriage which in turn is movable on a rail extending at right angles to the bar. Adjustable stops are provided to limit movement of the bar and carriage so that the router may be guided in a rectangular path of movement of predetermined dimensions. Selectively usable templets are provided for changing the path of movement of the router, particularly at the corners of the predetermined rectangular path to vary the design being routed.

19 Claims, 9 Drawing Figures

FIG.7
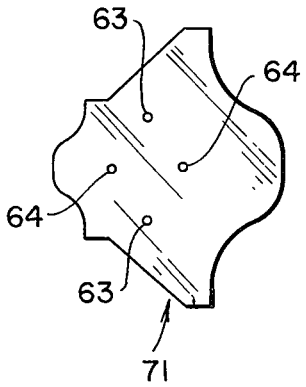
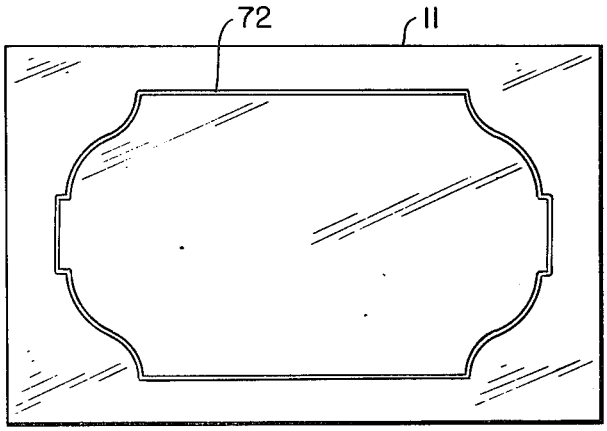
FIG.8
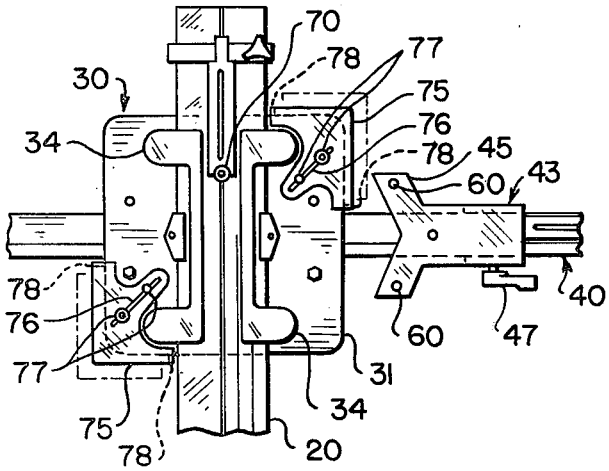
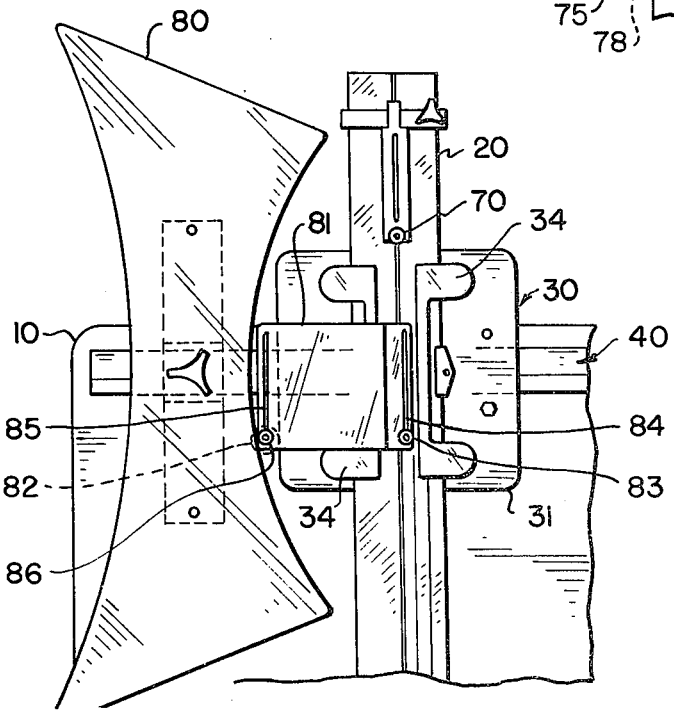
FIG.9

APPARATUS FOR ROUTING DESIGNS IN PANELS

SUMMARY OF THE INVENTION

The present invention relates to routing apparatus and, more particularly, to apparatus for supporting and guiding a router for use in the production of ornamental designs in the surface of flat panels such as cabinet doors, drawer fronts and the like.

An object of the invention is to provide an apparatus for supporting and guiding a router in engagement with the surface of a panel, which apparatus can be easily and quickly adjusted to produce designs of varying configurations as desired and to produce such designs in a wide range of dimensions to permit the routing of the designs in panels of widely ranging sizes and varying thicknesses.

A related object of the invention is to provide such an apparatus which when adjusted to produce a selected design of selected dimensions is adapted for high volume production of routed panels in that a panel to be routed can be easily and quickly located on the apparatus in position to be routed and, after the routing operation is completed, can be easily and quickly removed and replaced by a second panel and so on, to achieve a high output rate of completed panels.

Another object of the invention is to provide an apparatus as described which will achieve a high quality of workmanship and yet which is simple to adjust and simple to operate so that it is adaptable for use by persons of average skill and with a minimum of instructions.

A further object is to provide such an apparatus which is of rugged and compact design and reliable in operation, which is economical to produce, and which has a long operational life without need for repair or replacement.

Other objects will be in part obvious and in part pointed out in more detail in the following description and the accompanying drawing which set forth an illustrative embodiment of the invention.

BRIEF DESCRIPTION OF THE DRAWING

In the drawings:

FIG. 7 is a plan view of another form of templet for use with the apparatus and also depicting the design resulting therefrom;

FIG. 8 is a partial plan view of a modification of the carriage of the apparatus; and FIG. 9 is a partial plan view showing another form of templet which may be used with the apparatus.

DESCRIPTION OF THE PREFERRED EMBODIMENT

Figure 1:
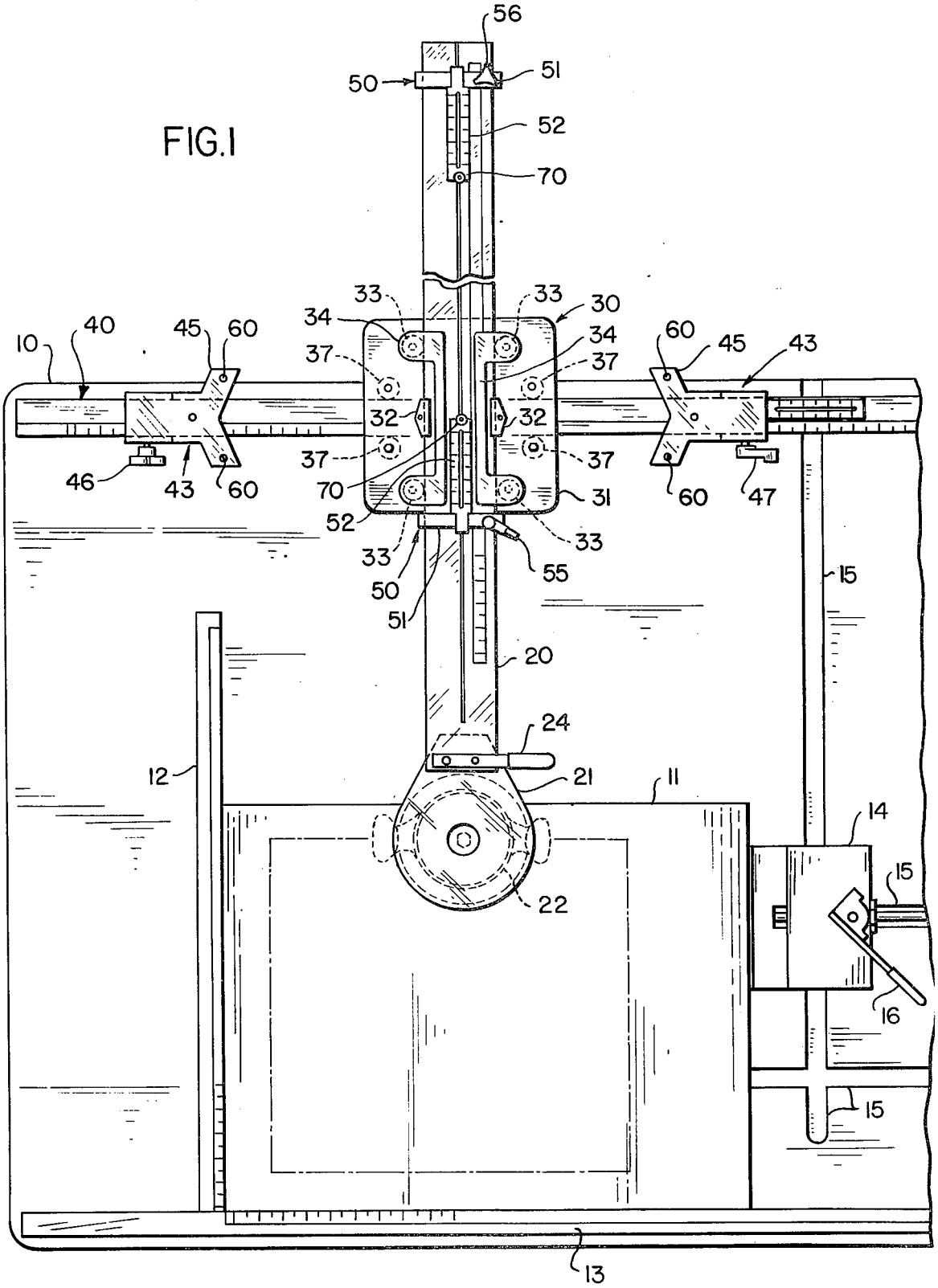
FIG. 1 is a plan view of an apparatus embodying the invention.

Referring to the preferred embodiment shown in the drawings, the apparatus includes a base or work table 10 on which a panel 11 is placed for a routing operation. Defining one corner of the work area and for use in proper placement of a panel on the table are a pair of abutments or ledges in the form of elongated bars 12 and 13 secured to the surface of table at right angles to each other, the bar 12 being adjacent the left hand lateral edge of the table and the bar 13 being adjacent the bottom longitudinal edge as viewed in FIGS. 1 an 2. The panel 11 to be worked upon is abutted against the bars 12, 13 and secured in place by a clamp 14 which is slidably received in the grooves 15 for movement to the desired clamping position and which can be secured in clamping position by locking means (not shown) operated by the handle 16. As indicated in the drawings, scale markings may be provided on the top surfaces of the bars 12, 13 to assist in the setting up of the apparatus as explained more fully hereinafter.

Figure 4:
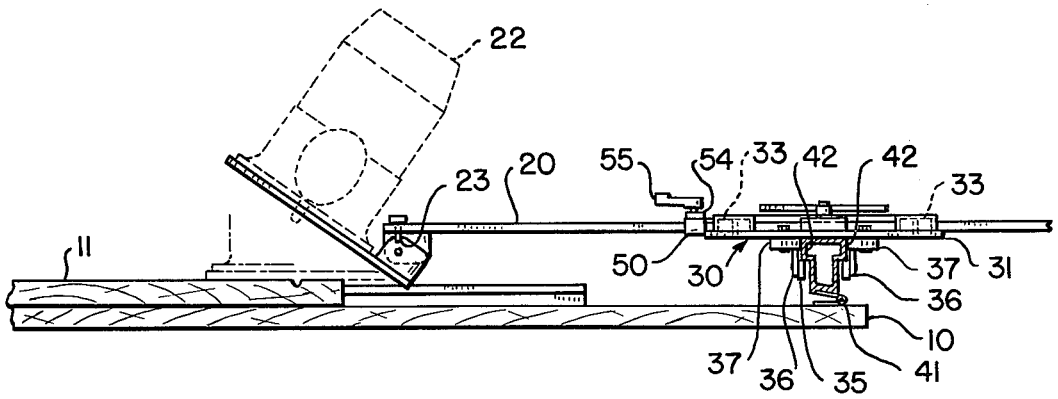
FIG. 4 is a cross-sectional view taken along the line 4—4 of FIG. 2.

Extending across the face of the work table and across the panel to be routed is a bar 20 extending parallel to the ledge 12. Pivotally mounted on the end of bar 20 is a universal type base plate 21 on which a conventional commercially available router 22 can be attached in the usual manner as indicated in phantom in FIGS. 1 and 4. When the router is not being used, it and the plate 21 to which it is attached, are preferably tilted backwardly as shown in FIG. 4 to a raised position away from the face of the table 10 and panel 11 where they will be automatically latched in raised position by the spring pressed latch 23 which can be manually released when a routing operation is to be performed by operation of the handle 24.

The opposite end of the bar 20 is mounted for longitudinal movement in a carriage 30 which has a base plate 31 on which the bar 20 rests and on which it is slidably held by L-shaped hold down members 32. Spaced apart rollers 33 mounted on the base plate 31 snugly engage the side edges of the bar 20 permitting the bar to slide longitudinally but accurately positioning the bar so that it is at right angles to the carriage 30 and is restrained from pivoting or rocking in a horizontal plane relative to the carriage 30. The members 34 are dust covers to protect the bearings of the rollers 33.

The carriage 30 is mounted for sliding movement on a rail 40 which is T-shaped in cross-section and which is mounted on the table 10 by means of a longitudinally extending piano hinge 41 thereby permitting the rail 40 to pivot on an axis parallel to the longitudinal axis of the rail. The hinge 41 and rail 40 are precisely mounted on the table 10 so that rail 40 is parallel to the panel locating bar 13 and thus parallel to the longitudinal edges of a panel 11 clamped against the bar 13.

The base plate 31 of the carriage 30 rides on the top of the rail 30 and is retained thereon by rollers 35 secured on opposite sides to the plate 31 by brackets 36 so that they engage under the shoulders 42 of the rail. Guide rollers 37 mounted on the underside of plate 31 snugly engage the side edges of the shoulders 42 of the rail 40 to prevent pivoting of the carriage 30 relative to the rail 40 but at the same time permitting the carriage 30 to slide easily along the rail 40.

Figure 3:
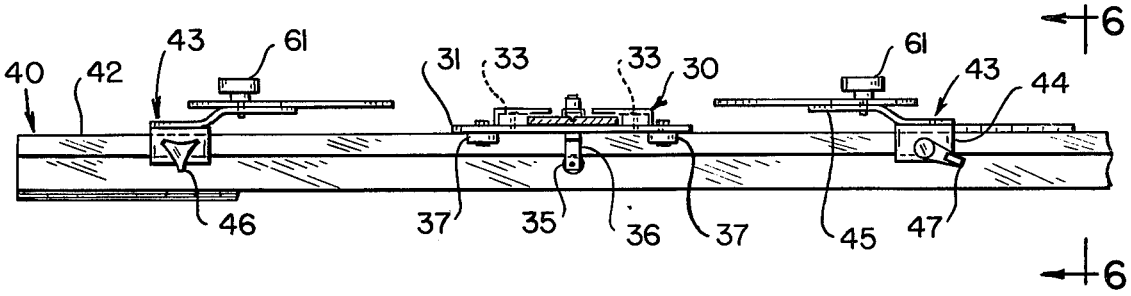
FIG. 3 is a cross-sectional view taken along the line 3—3 of FIG. 2.

The limits of sliding movement of the carriage 30 are controlled selectively by stops 43 each comprising a C-shaped slide 44 slidably engaging the top of the rail 40 and a Y-shaped plate 45 fixed to the top of the slide 44. The stops 43 may be held in selected longitudinal position on the rail 40 by set screws turned by a knob 46 in the case of the lefthand stop 43 (as viewed in FIG. 3) and by a lever 47 in the case of the other stop 43. The C-shaped slides 44 when locked in position on the rail 40 are engageable by the adjacent side edges of the carriage plate 31 and thus set the limits of movement of the carriage 30 on the rail 40.

The limits of longitudinal movement of the bar 20 are controlled selectively by means of adjustable stops 50 mounted on the bar 20 on opposite sides of the carriage 30. Each stop 50 is of T-shaped configuration with a cross-piece 51 and a center longitudinally extending portion 52. The end portions 53 of the cross-piece 51 are bent down and around the side edges of the bar 20 to position the cross-piece 51 at right angles to the bar but allowing sliding movement of the stop 50 longitudinally of the bar 20 to permit its position to be adjusted. Each of the stops 50 can be held in adjusted or preselected position by means of a set screw 54 connected to a turning lever 55 in the case of bottom stop 50 and to a knob 56 in the case of the other stop. The wrapped around end portions 53 limit longitudinal movement of the bar 20 by engaging against the adjacent edge of the carriage base plate 31.

With the apparatus as thus far described, it will be apparent that the carriage stops 43 and the bar stops 50 can be set in accordance with the dimensions of the panel 11 to be routed to preselect a rectangular area within the panel 11 in which the router 22 may be moved about. As will be noted in the drawing, indicia (preferably embossed) may be provided on the upper surface of the bar 20 and rail 40 which is correlated to the markings on the locating bars 12, 13 to facilitate accurate placement of the stops.

Once a selected rectangular area of the panel 11 has been predetermined by placement of the stops 43 and stops 50, it will be apparent that a router 22 mounted on the end of bar 20 can cut out any portion of the rectangular area merely by cooperative movement of the carriage 30 on the rail 40 and movement of the bar 20 relative to the carriage. This freedom of movement is an advantageous feature of the apparatus such as when it is desired to rout out the entire rectangular area for inlay purposes. However, it is contemplated that a more useful function of the apparatus will be for the cutting of individual straight lines in either dimension of the panel 11. As will be apparent, with the carriage 30 held in any stopped position, movement of the router 22 by reciprocation of the bar 20 will produce a straight-line cut in the panel parallel to the locating bar 12 and with the bar 20 held in any stopped position, movement of the router 22 as permitted by movement of carriage 30 along the rail 40 will produce a straight line cut in the panel parallel to the locating bar 13.

To produce a simple rectangular design in a panel, as shown in broken lines in FIG. 1, it is only necessary to take advantage of the stops 43 and 50 in sequence. For example, starting with the carriage 30 against the left-hand stop 43 as viewed in FIG. 1 and with the bar 20 against the lower stop 50 lowering the router into cutting position and moving the router to the right with accompanying movement of the carriage and while maintaining the bar against the lower stop 50 will produce the top line cut of the rectangular design as viewed in FIG. 1. Thereafter, moving the router with longitudinal movement of the bar as far as permitted by the upper stop 50 while maintaining the carriage 30 against the right hand stop 43 will produce the right side line of the design. Thereafter, moving the router to the left as permitted by return movement of the carriage 30 to the left hand stop 43 while maintaining the upper bar stop 50 against the carriage will produce the bottom line of the design and, finally, return of the router to original position while maintaining the carriage 30 against the left hand stop 43 will complete the rectangular design.

As will be apparent, the setting of the stops 43 and 50 can be preselected to provide any desired margins between the rectangular design and the edges of the panel and, also, after a first rectangular design has been routed, additional smaller or larger rectangular designs can be routed if desired merely by moving and resetting the stops accordingly. It is also to be noted that since the rail 40 can pivot because of the hinge 41 and the router mounting plate 21 is hingedly connected to the bar 20, the router 22 will always rest flatly on the panel being routed even though the panels being routed may vary in thickness.

Figure 2:
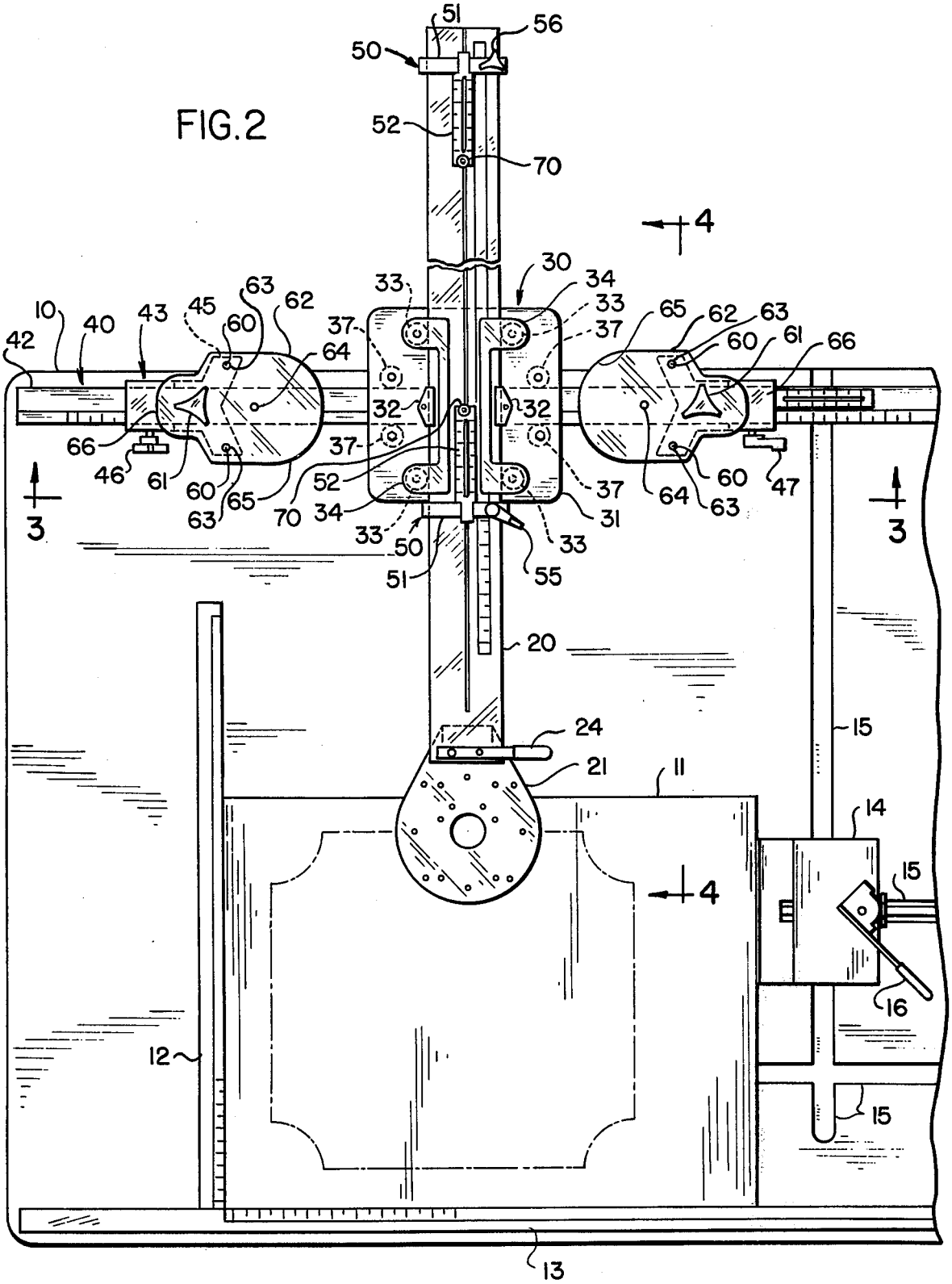
FIG. 2 is a view similar to FIG. 1 showing the apparatus with templets attached.

The apparatus of the invention also provides means for varying the contour of the corners of the design being routed in the panel. For this purpose, the plate 45 of each carriage stop 43 is provided with locating pins 60 and a threaded holding knob 61 for mounting a templet such as the templet 62. An exemplary templet 62 as shown in FIG. 2 has two locating holes 63 for receiving the pins 60 and since the templet 62 is reversible, it also has two holes 64 (one shown) for use selectively with the knob 61. In the specific example, templet 62 has two rounded edges 65, 66 of differing radii, the edge 65 of larger radius being intended for use in routing larger designs and the edge 66 being intended for use in routing smaller designs.

For cooperation with the templet 62, the longitudinally extending portion 52 of each of the bar stops 50 is provided with an upstanding roller follower 70 located so that when the router reaches the corner of the design being routed, it will be guided in accordance with the contour of the templet edges 65, 66. Referring to FIG. 2, the apparatus is shown with the parts located for routing the top edge of the design, i.e., with the bar 20 positioned with the inner stop 50 in engagement with the carriage 30. As the carriage 30 is slid to the right from this position toward the right corner, the carriage will slide under the templet 62 until the follower 70 engages the edge of the templet 62. Thus, further movement of the carriage to the right until it reaches the stop 43 requires that the follower 70 follow the contour of the templet 62 combining movement of the carriage 30 and the bar 20 to produce the corner design as shown in dotted lines in FIG. 2. Thereafter, with the carriage 30 against the right hand stop 43 and as the bar 20 is extended while the router cuts the right side of the design, the approach of the outer stop 50 toward the carriage will cause its follower 70 to engage the adjacent edge of the templet 62 and guide the router to form the second contoured cut at the lower right hand corner as viewed in FIG. 2. As will be apparent, the operation with the left hand templet 62 will be similar to produce the left hand portion of the design as viewed in FIG. 2. If desired, of course, only one templet 62 has to be used and mounted on either the left hand or right hand stop 43 to produce a design wherein only the left hand or right hand corners are contoured.

As will be appreciated, the templets can be contoured in a variety of ways to produce any desired corner configuration for the routed design. By way of additional example, there is shown in FIG. 7 a templet 71 having a reverse or compound curvature such that it will guide the router for the production of the design 72 as shown at the right hand side of FIG. 7.

An important feature of the invention is the fact that as viewed in FIG. 2 the upper portion of edge 65 guides the router for routing the lower corner of the design while the lower portion of edge 65 guides the router for routing the upper corner, thus permitting the use of small size templets and providing a very advantageous compactness of the structure of the apparatus. This advantage applies to all of the templets regardless of the specific contour selected.

Figure 5:
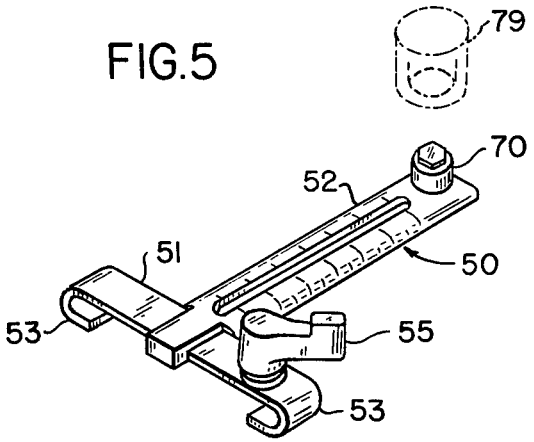
FIG. 5 is an enlarged perspective view of a bar stop of the apparatus.
Figure 6:
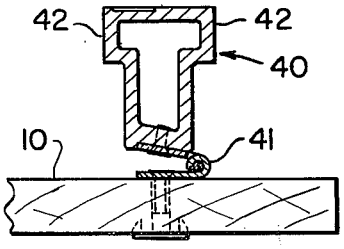
FIG. 6 is a cross-sectional view taken along the line 6—6 of FIG. 3.

A modification of the invention is shown in FIGS. 5 and 8 of the drawing for use when it is desired to route closely parallel lines in the panel without the necessity for moving or adjusting the stops 43 and 50. This is particularly advantageous for making side-by-side sequential cuts such as required to simulate a raised panel. Referring to FIG. 8, the modification entails the use of corner spacers 75 on the diagonally opposite corners of the carriage base plate 31. Each corner spacer 75 has a diagonal slot 76 slidably engaged by the screws 77 which are threaded into holes in the carriage plate 31. When the corner spacers 75 are in the "in" position as shown in solid lines in FIG. 8, the corner spacers 75 are positioned outwardly by the bent down tabs 78 which engage against the edges of the carriage base plate 31. When in this position, the corner spacers 75 are located so that they will engage the slide 44 of carriage stop 43 and be engaged by the cross-piece 51 of the bar stops 50 so that when the router is operated, the rectangular design being cut will be inwardly of the design which would be cut if the corner spacers were not present. If corner templets 62 are being used, sleeves 79 are placed over the followers 70 as shown in FIG. 5 to cause the routing of the corners with a cut similarly spaced inwardly from that which would normally be formed with the sleeves 79 removed. To make a second router cut outwardly of the first cut, all that it is necessary to do is remove the sleeves 79 and pull the corner spacers outwardly to the broken line position shown in FIG. 8 in which position they are outside the range of the stops 43 and 50 and will not engage or be engaged by the slide 44 or cross-piece 51 of the stops 43 and stops 50 respectively. The amount of displacement of the successive cuts provided by the corner spacers and sleeves 79 is the distance required to simulate raised panels.

A further modification of the invention is shown in FIG. 9 of the drawings to permit the routing of an arc as part of the design being routed in a panel 11. In this modification as shown in FIG. 9, the left hand carriage stop 43 is removed and replaced by a reversible arc templet 80 which is secured on the rail 40 in a manner similar to that shown and described in connection with the mounting of carriage stop 43. For cooperating with the templet 80, a bracket 81 is mounted on the bar 20 and is provided with a depending roller follower 82 (shown in dotted lines) for engaging the adjacent edge of the templet 80. The bracket 81 is secured to the bar 20 by a thumb screw 83 received in the slot 84 which allows for longitudinal adjustment in accordance with the size of the panel being routed. Additional longitudinal adjustment is provided by the slot 85 through which the threaded shaft of roller follower 82 extends and is secured in adjusted position by the thumb nut 86. With the apparatus set up as shown in FIG. 9, it will be apparent that instead of guiding the router by maintaining the carriage 30 against a stop, the operator will hold the follower 82 against the adjacent edge of the templet 80 thus causing the router to travel an arcuate path, this being accompanied by movement of the carriage 30 outwardly and then inwardly as the follower 82 follows the contour of the templet 80. As in the case of the followers 70, a sleeve may be placed over the roller follower 82 to permit a second spaced cut as described previously for simulating raised panels.

In addition to compactness, versatility and ease of operation of the apparatus described, a particular advantage of the apparatus derives from the fact that no connections need to be made to the panel being routed other than to clamp the panel against the locating bars 12 and 13. In addition to providing an unobscured view of the panel being routed, the absence of interfering structure permits the operator to easily and quickly remove a panel that has been routed and replace it with a second panel thus permitting a high output rate, particularly since no change or adjustment is required when the same design is to be produced in sequential panels.

As will be apparent to persons skilled in the art, various modifications, adaptations and variations of the foregoing specific disclosure can be made without departing from the teachings of the present invention.

I claim:

1. An apparatus for use with a router for routing designs in panels comprising:
   a. means providing a work surface;
   b. means to secure a panel in predetermined position on the work surface;
   c. a rail extending parallel to one edge of a panel secured in said predetermined position;
   d. a carriage mounted on the rail for sliding movement longitudinally of the rail;
   e. a bar mounted on the carriage for longitudinal reciprocating movement thereon at right angles to the rail
      i. said bar having an outer end adapted to extend over the panel to be routed;
   f. means on said outer end of the bar for mounting a router;
   g. adjustable stop means for determining the limits of movement of the carriage and the bar.

2. An apparatus as defined in claim 1 wherein the stop means are stops mounted on the rail and bar on opposite sides of the carriage and adjustable longitudinally of the rail and bar.

3. An apparatus as defined in claim 2 wherein indicia is provided on the rail and bar to facilitate the positioning of the stops in accordance with the dimensions of a panel secured in said predetermined position on the work surface.

4. An apparatus as defined in claim 2 wherein the rail is spaced from and of greater length than said one edge of the panel to be routed and said bar is of sufficient length to move the router across the width of the panel to be routed, and means are provided for locating the stops so that when the bar is held against the limits of its stops, movement of the carriage along the rail will cause a router supported on the bar to cut grooves parallel to the said one edge and opposite edge of a panel in said predetermined position, and when the carriage is held against the limits of the rail stops, longitudinal movement of the bar will cause the router to cut grooves parallel to the other edges of the panel thereby producing a rectangular design in the panel.

5. An apparatus as defined in claim 1 wherein the means for securing a panel in predetermined position comprises a pair of right-angled abutments on the work surface for engagement by two adjacent edges of the panel, and adjustable clamping means engageable with one other edge of the panel.

6. An apparatus as defined in claim 1 wherein the rail is hingedly mounted for pivoting movement on an axis parallel to the longitudinal axis of the rail.

7. An apparatus as defined in claim 1 wherein the means for mounting a router comprises a plate pivotally mounted on the outer end of the bar for movement toward and away from the panel to be routed, and including a manually releasable latch for holding the plate in elevated position.

8. An apparatus as defined in claim 6 wherein the means for mounting a router comprises a plate pivotally mounted on the outer end of the bar whereby the plate is adapted to rest flatly on the surfaces of panels of varying thickness.

9. An apparatus as defined in claim 4 wherein a templet is provided adjacent at least one of the stops on the rail, and at least one follower is provided on the bar for engagement with the templet to vary the longitudinal position of the bar as the carriage approaches said one of the stops thereby varying a corner position of the rectangular design being routed.

10. An apparatus as defined in claim 9 wherein the templet is a plate having at least one contoured edge and the plate is mounted on one of the stops on the rail.

11. An apparatus as defined in claim 9 wherein the templet has a pair of guiding surfaces, and the bar has a pair of followers engageable with said guiding surfaces in sequence when the carriage approaches said one of the stops on the rail and the bar is at the limits of its longitudinal movement permitted by the stops on the bar.

12. An apparatus as defined in claim 9 wherein the follower is positioned on the stop means mounted on the bar.

13. An apparatus as defined in claim 4 wherein the follower is an upwardly extending roller.

14. An apparatus as defined in claim 9 wherein the templet is a plate having end portions of different width but of corresponding contour.

15. An apparatus as defined in claim 4 wherein means is provided for producing a second series of cuts closely parallel to a first series of cuts comprising spacers attachable to the sides of the carriage.

16. An apparatus as defined in claim 15 wherein the carriage has a generally rectangular base plate and the spacers are corner pieces mounted on corners of the base plate and adjustable into and out of operative position.

17. An apparatus as defined in claim 13 wherein a removable sleeve is provided on the roller.

18. An apparatus as defined in claim 2 wherein an elongated templet having a contoured edge is mounted in place of one of the stop means on the rail, and a follower is mounted on the bar for engagement with the contoured edge of the templet.

19. An apparatus as defined in claim 18 wherein the follower is a roller, and a removable sleeve is provided on the roller.

* * * * *